United States Patent [19]

Rex

[11] Patent Number: 4,819,679

[45] Date of Patent: Apr. 11, 1989

[54] DISPOSABLE UMBRELLA

[76] Inventor: James R. Rex, 506 Mount Holyoke, Pacific Palisades, Calif. 90272

[21] Appl. No.: 212,806

[22] Filed: Jun. 29, 1988

Related U.S. Application Data

[63] Continuation-in-part of Ser. No. 48,093, Apr. 23, 1987, Pat. No. 4,754,773.

[51] Int. Cl.[4] ..... A45B 13/00; A45B 19/00

[52] U.S. Cl. ..... 135/19.5; 40/317

[58] Field of Search ..... 135/19.5, 16, 20; 40/317, 586; 446/478, 488

[56] References Cited

U.S. PATENT DOCUMENTS

| | | | |
|---|---|---|---|
| 1,175,585 | 3/1916 | Berman | 135/19.5 |
| 2,430,042 | 11/1947 | Bisbing | 135/19.5 |
| 2,757,679 | 8/1956 | Rivkin et al. | 135/19.5 X |
| 4,062,369 | 12/1977 | Hermanson | 135/19.5 |
| 4,215,711 | 8/1980 | Hermanson | 135/19.5 |
| 4,754,773 | 7/1988 | Rex | 135/19.5 |

*Primary Examiner*—J. Karl Bell

*Attorney, Agent, or Firm*—Nilsson, Robbins, Dalgarn, Berliner, Carson & Wurst

[57] ABSTRACT

A disposable umbrella is formed from a single sheet of corrugated material and has a first fold line dividing the sheet into two essentially imperforate panels and forming a peaked-roof shape, with each of the panels having a handle-forming foldout tongue formed along second fold lines disposed perpendicular to the first fold line.

8 Claims, 1 Drawing Sheet

DISPOSABLE UMBRELLA

This is continuation-in-part of application Ser. No. 07/048,093, filed Apr. 23, 1987, the disclosure of which is incorporated herein by reference.

FIELD OF THE INVENTION

This invention relates to umbrellas, and more particularly, to an inexpensive disposable umbrella and a method for its manufacture.

BACKGROUND OF THE INVENTION

Standard umbrellas are inconvenient to carry and are therefore often unavailable when needed. Several types of inexpensive and disposable umbrellas have been developed which permit the purchase of the umbrella at convenient locations at the onset of inclement weather, and then disposal after one or a few uses. Some of these disposable umbrellas are disclosed in U.S. Pat. Nos. 2,552,461; 2,563,353; 2,757,679; 4,062,369; 4,182,353; 4,215,711; and 4,370,993; Netherlands Pat. No. 7,607,179 and United Kingdom Pat. No. 347,678. While the umbrellas disclosed in the above-mentioned patents are relatively inexpensive in relation to the cost of a standard umbrella, they are still expensive for single use protection, difficult to assemble, or have limited durability. Accordingly, it has been a desideratum to provide a disposable umbrella which is sufficiently strong and easy to assemble to afford protection from extreme glare or inclement weather, and yet is sufficiently inexpensive to manufacture that the umbrella may be sold at a reasonable price or even distributed as an accommodation to customers by business establishments.

SUMMARY OF THE INVENTION

The present invention is directed to a disposable umbrella, and a method of manufacture, designed to minimize expense while maximizing durability and ease of assembly. The umbrella is of such a size and configuration that it may be easily stored for use, sale or distribution when needed.

The umbrella of the invention comprises a sheet with folding tongues, cut from a single piece of rigid or semi-rigid material, the sheet including two essentially imperforate panels having a common edge; and a panel fold line for folding the sheet into an essentially peaked-roof shape, the fold line being disposed between the two panels; with a fold out tongue being positioned on each of the panels and folding along a tongue fold line disposed at the common edge of each panel, the tongues being adapted to cooperatively form a handle and position the umbrella in the peaked roof shape. Preferably, one of the tongues further includes a locking tab and the other tongue has a tab lock opening for selectively receiving the locking tab to retain the tongues together in an aligned position.

Thus, the method for constructing the umbrella comprises the steps of cutting a sheet having two fold out tongues disposed along an edge of the sheet from a single piece of material; and then forming a panel fold line in the sheet, the panel fold line being essentially perpendicular to the sheet edge having the tongues, and forming an essentially imperforate side panel on either side of the fold line, with each such panel having one of the tongues extending therefrom, the panel fold line permitting the panels to be folded until the panels overlay each other in a closed position; and forming a tongue fold line between each tongue and the respective panel, the fold line permitting the tongues to be folded at about 90° to the respective panel and adapted to cooperatively form a handle and position the umbrella in a peaked-roof shape. Preferably, the tongues fold inwardly until the tongues overlay the panel and touch the panel in a closed position.

The terms "essentially imperforate", as used herein with respect to a sheet or panel, means that the sheet or panel has no planar openings which permit the transmission of rain water to the user. However, lateral perforations such as those which may be detected in a side view of corrugated cardboard are not included in this definition, and minor planar openings in the panel which do not interfere with the rain protective function of the umbrella are similarly excluded.

DESCRIPTION OF THE PREFERRED EMBODIMENT

Figure 1:
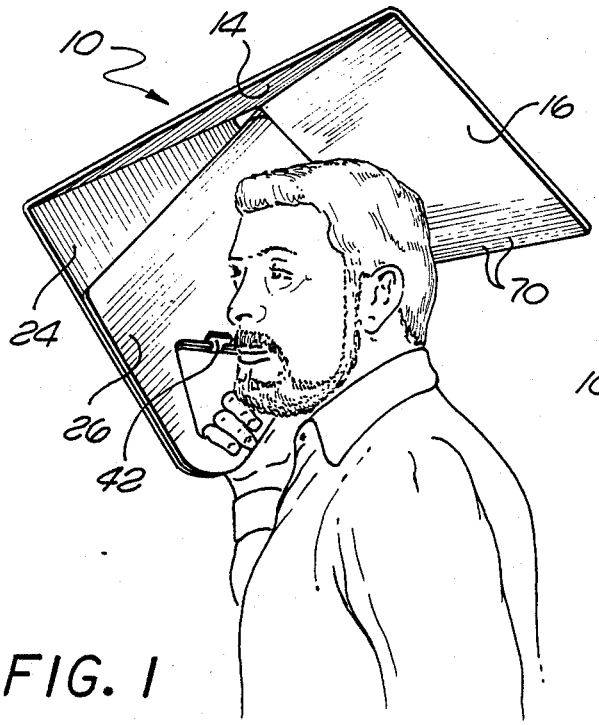
FIG. 1 is a perspective view of the umbrella of the invention in use.
Figure 2:
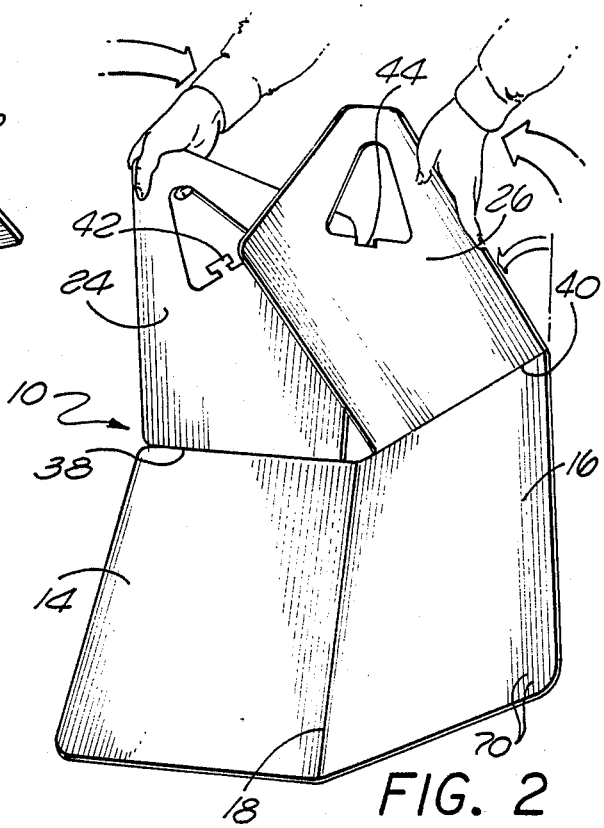
FIG. 2 is a bottom perspective view of the embodiment in FIG. 1 showing the umbrella being assembled by the user.
Figure 3:
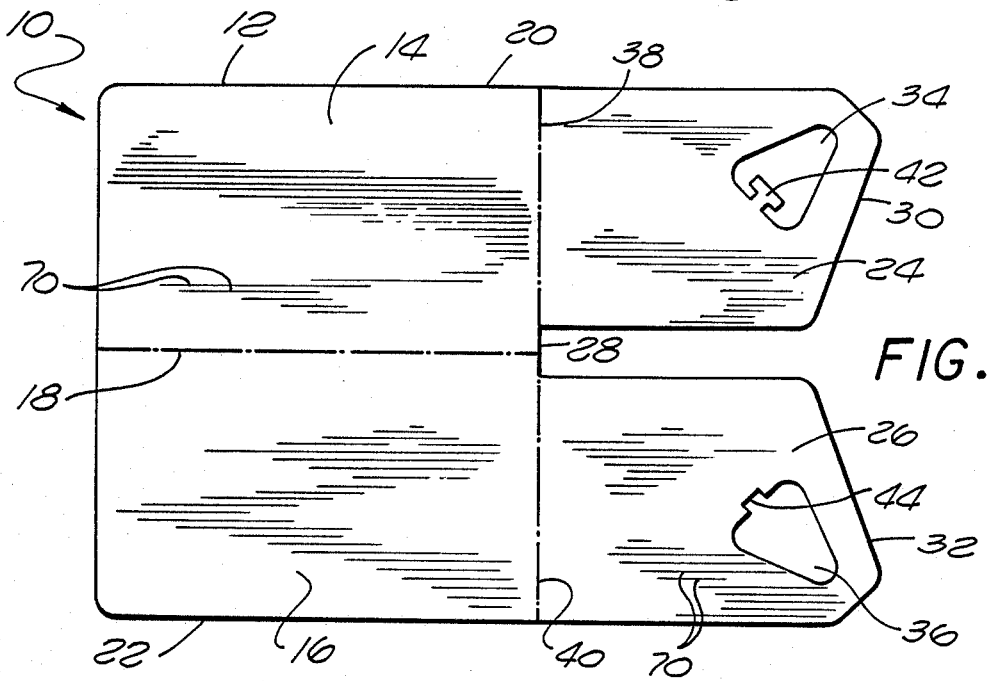
FIG. 3 is a bottom plan view of the invention in a flat open position.

Referring to FIGS. 1 and 2, a disposable umbrella is shown, designated by the reference numeral 10. FIG. 1 shows the umbrella 10 in use and FIG. 2 is a bottom perspective view as the umbrella is being assembled by the end user. FIG. 3 shows the umbrella 10 in a flat open position prior to use.

The umbrella 10 is shown most clearly in FIG. 3 to be constructed from a single sheet 12. The sheet 12 is cut or otherwise formed from a single piece of rigid or semi-rigid material, and preferably is die-cut from a single sheet of corrugated cardboard. The use of a single sheet of such material provides significant advantages in strength and ease of manufacture.

The sheet 12 is seen to include two side panels 14 and 16, which are shown here to be of equal size of about 12×18 or larger. The panels 14 and 16 are separated by a center fold line 18. The fold line 18 may be formed by scoring or crimping the corrugated cardboard during manufacture, or if the corrugations run parallel to the sides 20 and 22 of the sheet 12, the fold line 18 may be formed by appropriate bending of the sheet 12 by the manufacturer or the user. If desired, a plurality of center fold lines may be formed adjacent the fold line 18.

A pair of folding tongues 24 and 26 extend from a common edge 28 of the panels 14 and 16. The tongues 24 and 26 are employed as support means for the umbrella 10 and include tapering edges 30 and 32 and triangular openings 34 and 36 which cooperate to form a handle means which may be grasped by the user as shown in FIG. 1. Tongue fold lines 38 and 40 are formed by scoring, crimping or otherwise, along the common edge 28 of the panels 14 and 16. The fold lines 38 and 40 facilitate the folding of the tongues 24 and 26 as shown in FIG. 2. In addition, significant advantages are provided by folding the tongues inwardly to overlie the panels 14 and 16 during storage. In this case, following the inward folding of the tongues 24 and 26 the panels 14 and 16 are also folded inwardly along the center fold line 18 so that the umbrella 10 may be stored as a flat, compact shape the size of the panels 14 or 16.

Preferably, locking means are provided to secure the tongues 24 and 26 when the umbrella 10 is folded into a peaked-roof shape. In FIG. 3, the tongue 24 has a locking tab 42 and the tongue 26 has a locking opening 44, each of which may be die-cut from the single piece of material in the same unitary operation which forms the panels 14 and 16, the tongues 24 and 26, and any of the fold lines for which stamping or crimping is desired. When the umbrella 10 is folded into the peaked-roof shape, as seen in FIG. 1, the locking tab 42 is folded into the opening 44 when the tongues 24 and 26 are aligned. In the embodiment shown in FIG. 2, the locking means is not employed.

The method of use of the umbrella 10 is shown in the drawings. First, the umbrella may be stored by stacking the umbrella in a flat, open position such as is shown in FIG. 3, folded singly along the fold line 18, or folded along the center fold line 18 with the tongues 24 and 26 folded inwardly to overlie the panels 14 and 16. The extent of folding required for storage will be dependent upon the nature of storage and shipping space. Preferably, both the tongues and the panels will be folded inwardly to minimize the lateral space needed for storage and shipment of the umbrella. Having withdrawn the umbrella from storage, the user will then open the panels and unfold the tongues until the openings 34 and 36 overlie. The handle thus formed may then be grasped by the user to maintain the umbrella in a peaked-roof shape, or the locking tab means may be employed to secure the tongues. Whether secured by the user or by a locking tab, maintaining the openings 34 and 36 in an overlying position will easily maintain the panels 14 and 16 in a peaked-roof shape.

The umbrella may be made from any singular sheet of rigid, water-resistant material, such as waxed cardboard or cardboard coated with some other suitable water-resistant material such as lacquer, varnish, or a water repellant resin. Preferably, a corrugated board which is impregnated with a water-resistant polymer starch is employed to yield a strong, light, semi-rigid configuration.

In the preferred embodiment, a paperboard sheet of corrugating medium is shaped into continuous rolling waves, called "flutes". Observed horizontally, as in FIG. 4, the flutes form arches 60 and 62. Observed vertically, the arches form a row of columns, a basic structural form capable of supporting great weight. The arches 60 and 62 serve as ridges which, when bonded to the liners 54 and 56 as described, form ridge markings 70 as are shown in FIGS. 1,2 and 3. Disposing the corrugated medium so that the ridges are parallel to the panel fold line, and perpendicular to the tongue fold lines, adds significantly to the overall strength and rigidity of the umbrella in the peaked-roof position.

The paperboard to be corrugated moves from a supply roll in a web which is softened with steam in a preconditioner step, and then formed into flutes or arches by pressing it between meshed rolls which fit together like huge gears. As the corrugated web emerges from the forming operation, the Michelman X-300 water-resistant polymer starch, preferably mixed with a water resistant adhesive, is applied to both sides of the medium. While it is only necessary to apply such glue to the tips of the flutes in order to secure the medium 52 to the liners 54 and 56, significant advantages in strength and water resistance result when the entire medium 52 is coated with the water resistant resin.

After the glue is applied, the flutes are then pressed against the liner boards 54 and 56 which are thus secured to either side of the medium 54. Both liners are preheated, and the adhesive is applied to the flutes just before the respective liner meets the arches. Generally, heat is applied to properly cure the adhesive.

The corrugated board, which now consists of two facings and a fluted corrugated medium there between, passes toward the movable knife-edged wheels or die cutting assembly which is employed to cut the sheet 12 into the form of the umbrella 10, and if desired to form the respective score lines thereon. However, prior to this die cutting operation the outer liner 56 is first coated with the Michelman X-300 polymer starch by spraying, brushing or through the use of a flood coater. This method of applying the water resistant coating, that is, applying the coating to the corrugated medium as well as to the outer liner, adds significantly to the strength and durability of the umbrella.

Figure 4:
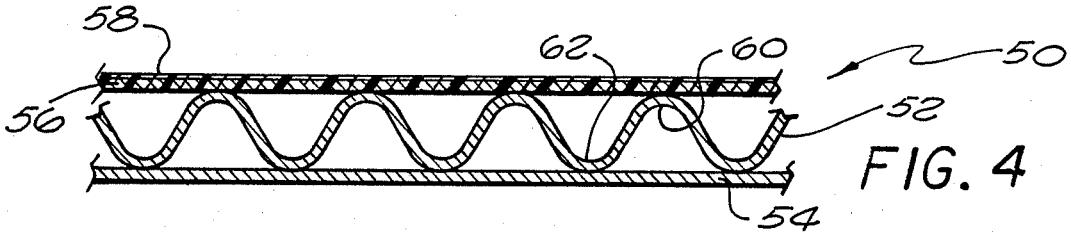
FIG. 4 is an enlarged cross-sectional view of the corrugated material from which the umbrella is constructed.

In the preferred embodiment, the corrugated board commonly referred to as cardboard is employed. Such material is manufactured by laminating a corrugated paperboard medium, which is shaped into a continuous rolling wave, between two paperboard liners. In FIG. 4, a corrugated board 50 is shown as including a medium 52 between an inner liner 54 and an outer liner 56. The outer liner 56 is shown to be impregnated with a layer 58 of water-resistant polymer starch. A polymer starch manufactured by Michelman Chemicals, Inc. and sold under the trade name Michelman X-300 has shown significant advantages, both in coating the outer liner of the corrugated board and in securing the liners to the corrugated medium.

What is claimed is:

1. A disposable umbrella, comprising a water resistant sheet and tongues cut from a single piece of material, the sheet including:

two essentially imperforate panels having a common edge; and a panel fold line for folding the sheet into an essentially peaked-roof shape, the fold line being disposed between the two panels (and essentially perpendicular to the common edge;

a tongue being positioned on each of the said panels and folding along a tongue fold line disposed at the common edge of each panel, the tongues being adapted to cooperatively form a handle and position the umbrella in a peaked-roof shape.

2. The umbrella of claim 1 wherein one of the tongues further includes a locking tab and the other tongue has a tab lock opening for selectively receiving the locking tab to retain the tongues together in an aligned position.

3. A disposable umbrella, comprising a water resistant sheet and tongues cut from a single piece of corrugated material formed from an inner and an outer liner on either side of a corrugated medium, with the outer liner and the medium being impregnated with a water-resistant coating, the sheet including:

two essentially imperforate panels having a common edge; and a panel fold line disposed for folding the sheet into an essentially peaked-roof shape, the fold line being disposed between the two panels and essentially perpendicular to the common edge;

a tongue being positioned on each of the said panels and folding along a tongue fold line disposed at the common edge of each panel, the tongues being adapted to cooperatively form a handle when the umbrella is positioned in a peaked-roof shape.

4. The umbrella of claim 3 wherein the corrugated medium includes ridges formed on either side thereof secured to and abutting the respective liners, with the panel fold line being disposed essentially parallel to the ridges.

5. A method for constructing an umbrella, comprising the steps of:

cutting a sheet having two tongues disposed along an edge of the sheet from a single piece of material;

forming a panel fold line in the sheet, the panel fold line being essentially perpendicular to the sheet edge having the tongues and forming an essentially imperforate panel on either side of the panel fold line, with each such panel having one of the tongues extending therefrom, the panel fold line permitting the panels to be folded until the panels overlay each other in a closed position;

forming a tongue fold line between each tongue and the respective panel, the fold line permitting the tongues to be folded at about 90° to the respective panel and adapted to cooperatively form a handle and position the umbrella in a peaked-roof shape, and to be folded inwardly until the tongues overlay the panel and touch the panels in the closed position.

6. The method of claim 3 wherein the step of cutting further includes cutting a locking tab in one of the tongues and a tab lock opening in the other tongue, the tab and opening being adapted to secure the tongues together when the umbrella is positioned in the peaked-roof shape by bending the locking tab into the tab lock opening.

7. A method for constructing an umbrella, comprising the steps of:

cutting a water resistant sheet having two foldout tongues disposed along an edge of the sheet from a single piece of corrugated material formed from an inner and an outer liner on either side of a corrugated medium, with the outer liner and the medium being impregnated with a water-resistant coating;

forming a panel fold line in the sheet, the panel fold line being essentially perpendicular to the sheet edge having the tongues and forming an essentially imperforate panel on either side of the panel fold line, with each such panel having one of the tongues extending therefrom, the panel fold line permitting the panels to be folded until the panels overlay each other in a closed position;

forming a tongue fold line between each tongue and the respective panel, the fold line permitting the tongues to be folded at about 90° to the respective panel and adapted to cooperatively form a handle and position the umbrella in a peaked-roof shape, and to be folded inwardly until the tongues overlay the panel and touch the panels in the closed position.

8. The method of claim 7 wherein the corrugated medium includes ridges formed on either side thereof, the ridges adhesively secured to and abutting the respective liners, with the panel fold line being disposed essentially parallel to the ridges.

* * * * *